US005981408A

United States Patent [19]

Nakagawa et al.

[11] Patent Number: 5,981,408

[45] Date of Patent: Nov. 9, 1999

[54] SCREEN TEXTILE MATERIAL

[75] Inventors: Junyo Nakagawa; Takashi Katayama, both of Kurashiki; Toru Yokomizo, Hachioji; Hiroki Sano, Fujiyoshida, all of Japan

[73] Assignees: Kuraray Co.,Ltd., Okayama-ken; NBC Industries Co., Ltd., Tokyo, both of Japan

[21] Appl. No.: 09/113,335

[22] Filed: Jul. 10, 1998

[30] Foreign Application Priority Data

Jul. 10, 1997 [JP] Japan ..... 9-200756
Jul. 10, 1997 [JP] Japan ..... 9-200757

[51] Int. Cl.[6] ..... D01F 8/14

[52] U.S. Cl. ..... 442/199; 442/200; 442/201; 442/352; 428/370; 428/372; 428/373; 428/374; 106/31.36

[58] Field of Search ..... 442/199 T, 352, 442/200, 201; 428/370, 372, 373, 374; 106/31.36

[56] References Cited

FOREIGN PATENT DOCUMENTS 280640 3/1990 Japan .
3220340 9/1991 Japan .
5230715 9/1993 Japan .
8260249 10/1996 Japan .

OTHER PUBLICATIONS

Patent Abstract of JP 08 260249 (Oct. 8, 1996).
Patent Abstract of JP 07 316926 (Dec. 5, 1995).
Patent Abstract of JP 06 123013 (Aug. 4, 1994).
Patent Abstract of JP 05 230715 (Dec. 17, 1993).
Patent Abstract of JP 03 220340 (Dec. 19, 1991).
Patent Abstract of JP 02 080640 (Mar. 20, 1990).

*Primary Examiner*—Marion McCamish
*Assistant Examiner*—Arti Singh
*Attorney, Agent, or Firm*—Sherman and Shalloway

[57] ABSTRACT

A screen textile material for high precision and high density screen printing is made of a core and sheath type conjugate fiber in which a core component is formed of a thermotropic liquid crystalline polyester (A polymer) and a sheath component is formed by blending a flexible thermoplastic polymer (B polymer) and a thermotropic liquid crystalline polyester (C type) with a blending ratio of the C polymer of 0.15 to 0.45. The core and sheath type conjugate fiber has a specific color specification values to perform high quality printing by prevention of halation.

18 Claims, 5 Drawing Sheets

SCREEN TEXTILE MATERIAL

BACKGROUND OF THE INVENTION

1. Field of the Invention

This invention relates to a screen textile material.

2. Description of Related Art

To realize high density and high precision printing by means of a screen textile material, the screen textile material needs to be placed possibly with a high tension, to have a smaller size change rate, and to have a large elastic recovery rate. Although screen textile materials using a fiber made of flexible polymers such as nylon and polyester are widely used, such screen textile materials have a low strength and a modulus of elasticity and do not have a satisfactory size stability.

For high performance printing areas such as for printing on printed circuit boards, a screen textile material made of fine stainless wires has been used, but the stainless wires raise a problem to make handling of the material uneasy. To solve such a problem, a screen textile material made of a thermotropic liquid crystalline polyester fiber has been proposed as disclosed in Japanese Unexamined Patent Publications (KOKAI), Heisei No. 2-80,640 and Heisei No. 3-220,340, etc.

Though the screen textile material made of only the thermotropic liquid crystalline polyester has no problem in terms of strength and modulus of elasticity, the material is easily made fibrillated because made from rigid polymers, so that the fibrils generated during the weaving process raise problems that the fibrils disturb permeability of ink and impair high precision printing.

Some screen textile materials are proposed to be formed of an islands-in-sea type fiber in which a thermotropic liquid crystalline polyester makes island components and a polyethylene-terephthalate makes a sea component, or a core and sheath type conjugate fiber in which a thermotropic liquid crystalline polyester makes a core component and another flexible polymer makes a sheath component. With those materials, however, the flexible polymers constituting the sheath or sea components, because of not drawn, are very brittle and have problems not only that their mechanical strength is not adequate but also that the sheath portions are easily exfoliated or dropped. If a ratio of the island components or core components were made higher to obtain adequate mechanical feature, the core components might have been exposed, thereby reducing abrasive resistance, and rendering productions as a business operation extremely hard.

To solve the above problems, the inventors have proposed a screen textile material using a core and sheath type conjugate fiber in which a core component is formed of a thernotropic liquid crystalline polyester (A polymer) and a sheath component is formed by blending a flexible thermoplastic polymers (B polymer) and a thermotropic liquid crystalline polyester (C type), as disclosed in Japanese Unexamined Patent Publications (KOKAI), Heisei No. 5-230,715 and Heisei No. 8-260,249. Such a screen textile material has a good size stability, good mechanical property and good resistance against fibrils. The material has property more satisfactory than that made of fine stainless wires.

SUMMARY OF THE INVENTION

It is an object of the invention to provide a screen textile material having further excellent printing capability for printing with higher density and higher precision.

The foregoing object is accomplished by a screen textile material using a core and sheath type conjugate fiber in which a core component is fonned of a thermotropic liquid crystalline polyester (A polymer) and a sheath component is formed by blending a flexible thermoplastic polymer (B polymer) and a thermotropic liquid crystalline polyester (C type) with a blending ratio of the C polymer in the mixture of the C polymer and B polymer is from 0.15 to 0.45, wherein the core and sheath type conjugate fiber has the following color specification values:

$$18 \leqq b^* \leqq 35 \quad (1)$$

$$0.5 \leqq a^* \leqq 10 \quad (2)$$

$$55 \leqq L^* \leqq 80 \quad (3)$$

wherein $b^*=200[(Y/Y_0)^{1/3}-(Z/Z_0)^{1/3}]$ $a^*=500[(X/X_0)^{1/3}-(Y/Y_0)^{1/3}]$ $L^*=116(Y/Y_0)^{1/3}-16$, and X, Y, and X denote tristimulus values.

According to a preferred embodiment, the core and sheath type conjugate fiber forming the screen textile material preferably has some features such as a strength of 10 g/d or more, a modulus of elasticity of 400 g/d or more, a diameter of 45 microns or less, a surface having gentle ups and downs. The core and sheath type conjugate fiber may contain a colorant in an amount of 0.1% by weight or less. The flexible thermoplastic polymer may be polyphenylene sulfide. The screen textile material can be in a form of a mesh woven using core and sheath type conjugated monofilaments. Where the mesh woven may have a tear strength X (gf) and a yarn diameter Y (microns) of yarns arranged along the tearing direction among yarns constituting the mesh woven, the mesh woven satisfies that the value of $X/Y^2$ is 0.32 or more and that an opening area is 35% or more. The screen textile material may have a tear strength of 200 gf or more, and a density of 200 meshes or more.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1A:
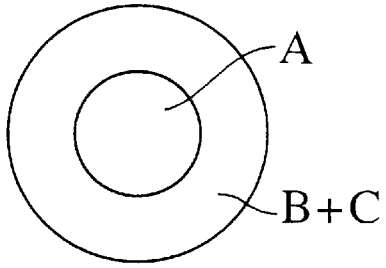
FIGS. 1(*a*) to 1(*g*) are illustrations showing lateral cross sections of various embodiments of a conjugate fiber used for the invention.
Figure 1B:
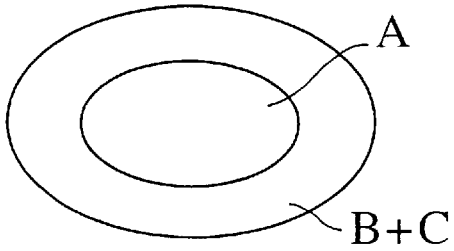
Figure 1C:
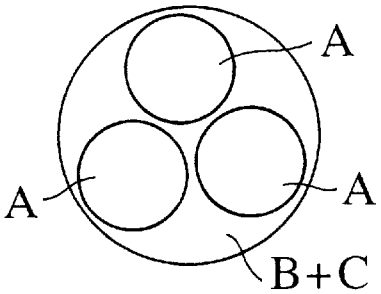
Figure 1D:
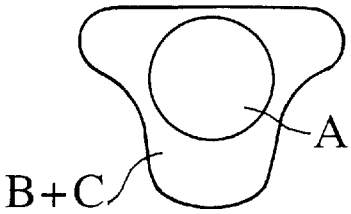
Figure 1E:
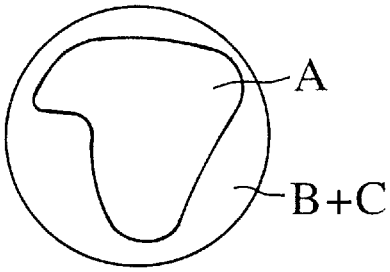
Figure 1F:
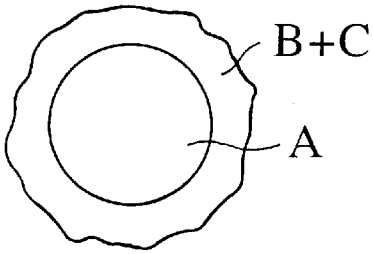
Figure 1G:
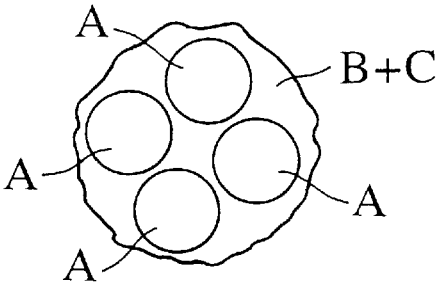

The term "thermotropic liquid crystalline (anisotropy)" in this invention means to indicate optical liquid crystalline property (anisotropy) at melting phase. For example, it is recognizable by observation of transmission light through a specimen where the specimen is mounted on a hot stage and heated in a nitrogen atmosphere.

An aromatic polyester used for this invention is made of repetitive structural units of aromatic diol, aromatic dicarboxylic acid, or aromatic hydroxycarboxylic acid, etc., and it is preferable to form a combination of repetitive structural units shown in the following structural formulas.

(1)

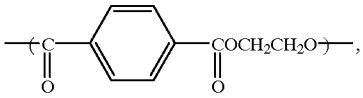

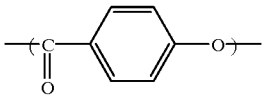

(2)

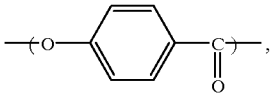

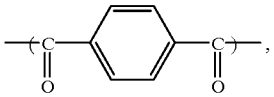

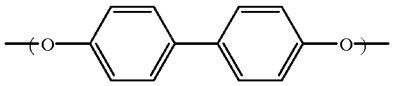

(3)

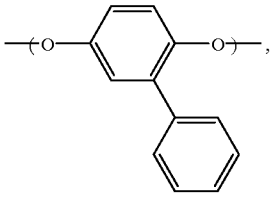

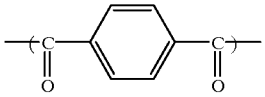

(4)

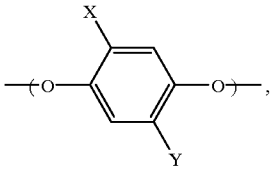

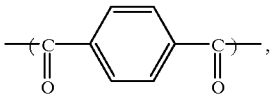

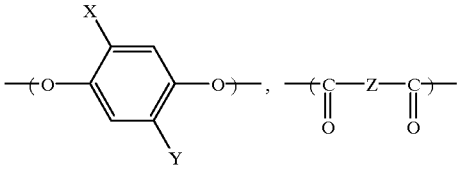

wherein X, X′ and Y, Y′ are H, Cl, Br, or $CH_3$, and Z is

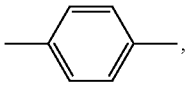

-continued

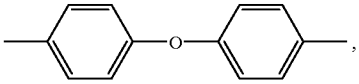

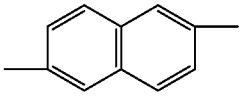

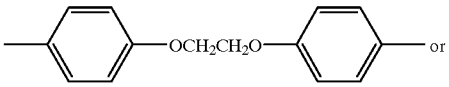

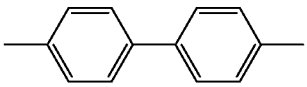

(5)

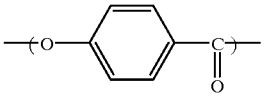

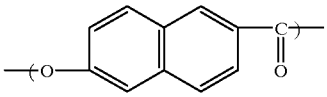

(6)

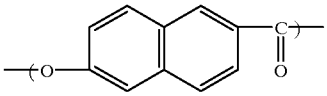

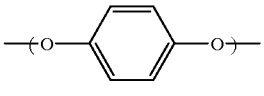

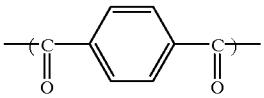

(7)

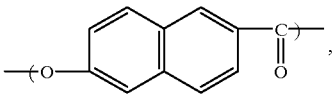

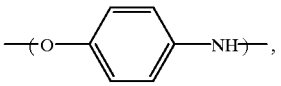

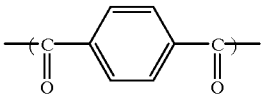

(8)

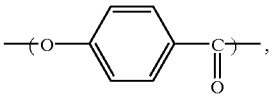

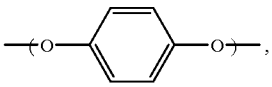

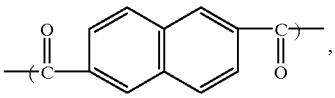

-continued

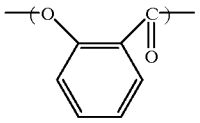

(9)

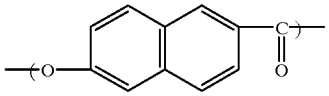

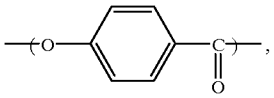

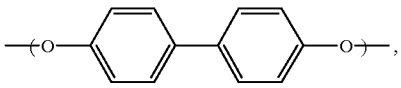

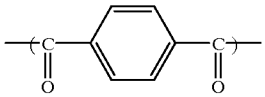

(10)

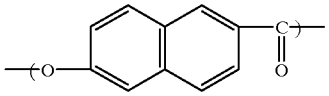

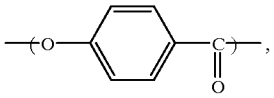

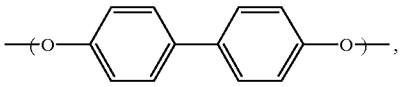

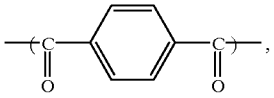

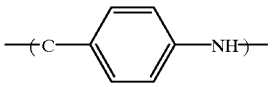

(11)

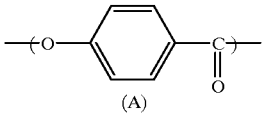

(A)

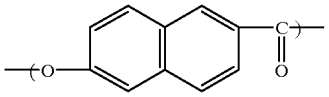

(B)

(12)

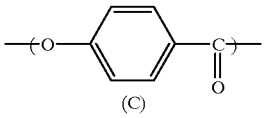

(C)

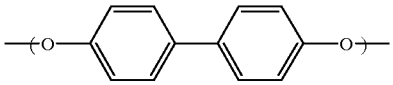

(D)

-continued

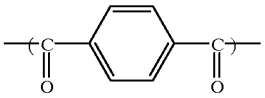

(E)

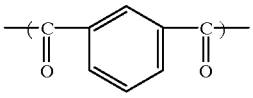

(F)

The aromatic polyester is more preferably a polymer made of a combination of repetitive structural units shown in Formula (11) and (12). Specifically, a polymer having repetitive structural units of (A) and (B) in Formula (11) of 65% by weight or more, and more preferably, an aromatic polyester in which the component of (B) is 4 to 45% by weight.

The melting point ("MP")of a desirable thermotropic liquid crystalline polyester is 260 to 360° C., preferably, 270 to 350° C. The term "melting point" herein is a peak temperature of a main endothermic peak observed by a differential scanning calorimeter ("DSC"; e.g., TA3000 made by Mettler Corp.) as provided in JIS K7121. More specifically, after a sample of 10 to 20 mg is inserted in an aluminum pan within a DSC device, nitrogen gas is purged as a carrier gas at 100 cc/min, and an endothermic peak is measured when heated at 20° C./min. When no apparent endothermic peak comes out in the first time due to kinds of polymers, an endothermic peak can be measured at a heating rate of 20° C./min where the specimen is cooled at 50° C. at a rate of 80° C./min after the specimen is heated at a temperature 50° C. higher than a flowing temperature expected from a heating rate of 50° C./min and melted completely at the temperature for three minutes.

The B polymer used for the invention is not limited as far as a flexible thermoplastic polymer, and exemplified are polyolefin, polyamide, polyester, polycarbonate, polyphenylene sulfide (PPS), polyether etherketone fluoroplastic, etc. As the B polymer, particularly, PPS, or polyethylene naphthalate is preferable, and inter alia, PPS, particularly straight-chain PPS gives good spinning capability and can have remarkable effects in terms of chemical resistance, mechanical strength, abrasive resistance, and the like. It is to be noted that the term "flexible polymer" herein means a polymer having no aromatic cycle in the main chain or a polymer having aromatic cycles in the main chain and four or more atoms on the main chain between aromatic cycles.

The C polymer can be formed of a theniotropic liquid crystalline polyester as well as the A polymer, and the A polymer can be the same as or different from the C polymer in terms of the resin type. The melting point of the C polymer is preferably no more than a temperature 80° C. higher than the melting point MP and no less than a temperature 10° C. lower than the melting point MP of the B polymer.

In the A, C polymers used for this invention, some thermoplastic polymer such as polyethylene terephthalate, modified polyethylene terephthalate, polyolefin, polycarbonate, polyarylate, polyamide, polyphenylene sulfide, polyether etherketone, fluoroplastic, etc. can be added as far as the polymer does not reduce the effects of the invention. The B polymer may contain polymer or polymers other than the flexible thermoplastic polymers as far as the B polymer does not lose effects of the invention, and the B polymer may use plural types of the flexible thermoplastic polymers. The A, B, and C polymers may be blended, as far as the polymers do not lose effects of the invention, with various additives such as colorants, such as inorganic materials such as titanium oxides. kaolin, silica, barium oxides, etc., carbon black, dyes, and pigments, etc., antioxidants, ultraviolet ray absorbents, and photo-stabilizers, etc.

In this invention, the sheath component is made not solely of the flexible thermoplastic polymer (B polymer) but of the flexible thermoplastic polymer (B polymer) and the thermotropic liquid crystalline polyester (C polymer), thereby considerably enhancing the strength of the sheath component as well as adherence between the sheath component and the core component.

Figure 2:
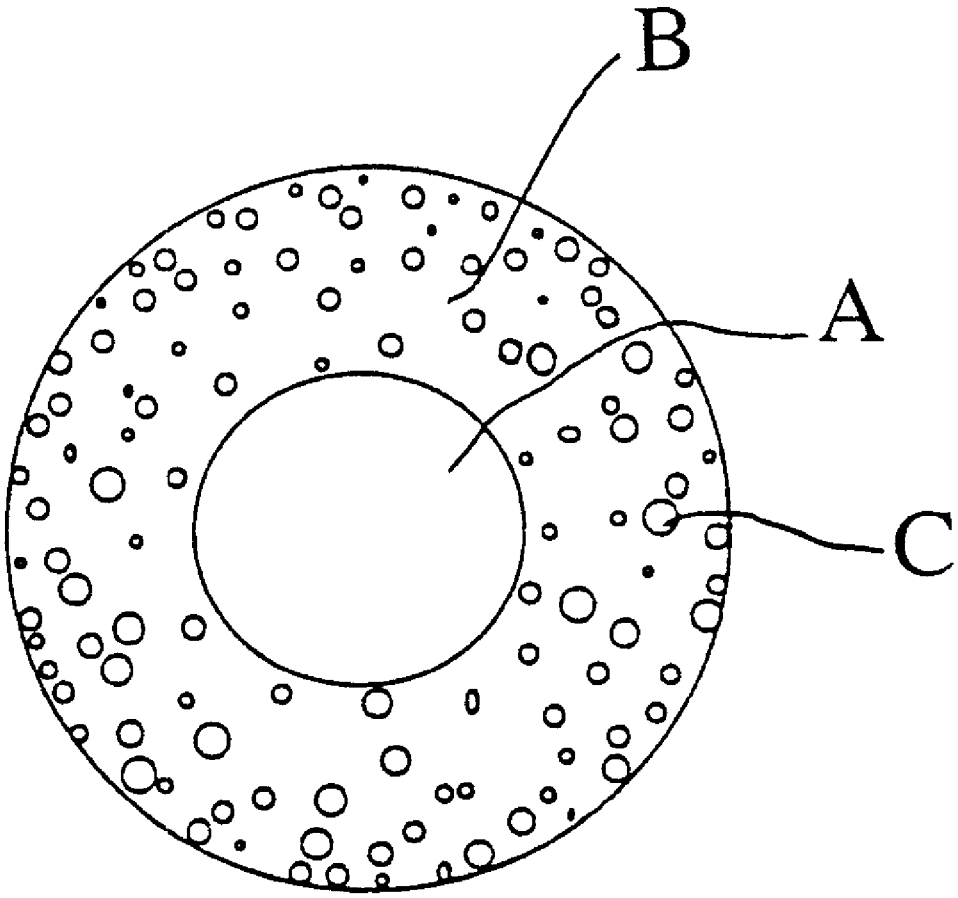
FIG. 2 is an illustration showing a cross-sectional fiber structure that is expected to be formed by the conjugate fiber used for the invention.

Blend for forming the sheath component is obtainable by mixing chips of B and C polymers or mixing both polymers while melting by means of a static mixer or the like. In this invention, because the sheath component is constituted by using the soft B polymer in a large amount in comparison with the C polymer, it is presumed that the sheath component has an islands-in-sea structure where the C polymer forms island components and the B polymer forms a sea component (see, FIG. 2). In FIG. 2, A denotes the A polymer; B denotes the B polymer; C denotes the C polymer. The C polymer, which is rigid and excellent in physical property, constitutes the island components to perform reinforcing effects, and the B polymer, which has an excellent abrasion resistance, constitutes the sea component and substantially encloses the surroundings of the C polymer to remarkably improve the abrasion resistance. The term "islands-in-sea structure" herein means a state that 50 or 60 to 50000 or 60000 islands are located in the sea component as a matrix when seen to a cross section of the fiber. By changing of the blending ratio of the B and C polymers and the melting temperature, the number of islands can be controlled. From an aspect of fiber strength and fibril resistance, the island components are preferably fine sizes, and the island components preferably have a diameter of 0.01 to 0.5 micron.

Orientation of the B polymer upon adequately drawing of the fiber might be needed to improve strength of the B polymer constituting the sheath component. However. the thermotropic liquid crystalline polyester constituting the core component has, only upon spinning, an excellent physical property without subject to drawing, and the raw spun yarn itself has significant orientations. If the raw spun yarn is further drawn to elevate the strength of the sheath component, such further drawing would be substantially unsuccessful since the A polymer constituting the core component has already highly oriented. As a result, the obtained sheath component of the conjugate fiber becomes very brittle, and the sheath component comes to be easily peeled from the core component, thereby making the fiber hard to be processed and abrasion resistance thereof inadequate, and disturbing high precision printing in impairing permeability of ink where the core and sheath components are peeled and fibrils are created.

With this invention, however, because the thermotropic liquid crystalline polyester is blended in the sheath component, the sheath component is hardly peeled from the core component where the sheath component has a higher affinity to the core component made of a similar polymer to the sheath component, and the thermotropic liquid crystalline polyester constituting the sheath component is highly oriented as in a raw spun yarn state, thereby improving the strength of the sheath component, and thereby remarkably improving abrasion resistance and the like. Particularly, even when the screen textile material has a small aperture or apertures, the screen textile material can enjoy excellent property of the material in size stability, abrasion resistance, and so on.

The blend ratio C/(B+C) of the C polymer in the sheath component is designed to be 0.15 to 0.45, preferably 0.25 to 0.4 (ratio by weight). When the blend ratio of the C polymer is too high, the abrasion resistance of the fiber becomes inadequate, and the fiber becomes hard to be processed in a weaving step due to rigidity of the fiber. To the contrary, when the blend ratio of the C polymer is too low, the strength of the sheath component becomes inadequate, thereby easily inflicting peelings between the core and the sheath and lowering the productivity in the weaving process. Moreover, the fiber may hardly obtain prescribed color specification values.

The core and sheath type conjugate fiber according to the invention may include a core and sheath type fiber with an eccentric core and a core and sheath type fiber with multiple cores. The core component ratio in the conjugate fiber is 0.25 to 0.80, and preferably, 0.3 to 0.7. The term "core component ratio" herein means cross-sectional ratio (A)/(A+B+C) of the conjugate fiber. The cross-sectional ratio, though can be obtained from a microscope photograph viewing the lateral cross section of the fiber, can be computed from a spun volume ratio of the core and sheath components when manufactured.

The major feature of the invention is use of the core and sheath type conjugate fiber having special color specification values. Setting the special color specification values suppresses halation from occurring when an emulsion is exposed to light, thereby making clear boundaries between masked portions and unmasked portions, and enabling the material to form dense and precise patterns.

The color specification values b*, a*, L* were recommended by the CIE in 1976 and are values defined by the following formulas $$18 \leqq b^* \leqq 35 \quad (1)$$

$$0.5 \leqq a^* \leqq 10 \quad (2)$$

$$55 \leqq L^* \leqq 80 \quad (3)$$

wherein $b^*=200[(Y/Y_0)^{1/3}-(Z/Z_0)^{1/3}]$ $a^*=500[(X/X_0)^{1/3}-(Y/Y_0)^{1/3}]$ $L^*=116(Y/Y_0)^{1/3}16$, where X, Y, and Z are tristimulus values on the perfectly diffuse surface.

Generally, b* represents yellow tint; a* represents red tint; L* represents white tint. Tints of yellow, red, white are made stronger as the number is larger. Those color specification values can be measured easily by a color analyzer (e.g., C-200S, made by Hitachi).

Using such a colored conjugate fiber having such color specification values reduces influences due to halation, makes clear the boundaries between the masked portions and the unmasked portions, and offers dense and precise pattern formations. Therefore, a clear fine pattern printing can be made which can not be obtained by a screen made of stainless fine wires. In particular, the b* value plays a major role to affect the printing quality, and it is preferable to set it 20 or more and 35 or less, more preferably, 25 or more and 33 or less.

When the b* is too small, halation occurs to make edges obscure; when the b* is too large, light may inadequately be transmitted to the back side of the screen upon increase of not only yellow tint but also black tint, thereby possibly preventing the emulsion existing at the back side from exposing to the light. When the a* is too small, halation may not be prevented sufficiently due to increase of only yellow tint even where the b* is proper; contrarily, when the a* is too large, halation may not be prevented sufficiently due to much increase of red tint. When the L* is too small, halation may not be prevented sufficiently due to increase of gray tint; contrarily, when the L* is too large, halation similarly may not be prevented sufficiently because it comes close to white. The a* value is preferably set to 1.0 or more and 5.5 or less; the L* is preferably set to 60 or more and 78 or less.

A method to obtain a fiber having such color specification values is not limited. For example, a method in which yellow colorants (e.g., pigments, dyes, etc.) are added to the B polymer and/or the C polymer can be exemplified. Mixture of the colorants may be done by directly adding them to the B polymer and/or the C polymer or by diluting master chips of a high concentration by a blend method while fiber is formed. As a colorant, carbon black, pigment (including titanium oxide), dye having heat resistance can be used, and it preferably has a particle diameter of 0.01 to 2 microns.

However, if the colorant is blended, the physical property of the fiber may be impaired, and there raises a problem that the core and sheath components tend to be separated. Therefore, the blend amount of the colorants is set to 0.1% by weight or less in proportion to the entire weight of the fiber and, preferably, to 0.01% by weight or less, and more preferably, substantially no colorant is blended, so that the fiber is preferably colored by a method not using any colorant. When the fiber diameter is small, particularly, when the fiber diameter is 33 microns or less, blending of colorants has great influences.

Although a fiber having desired color specification values can normally be obtained where the thermotropic liquid crystalline polyester fiber is made subject to a heat treatment in an active atmosphere, such a normal method does not produce the conjugate fiber when the sheath component is made from a blend of the B polymer and the C polymer. The reason is not yet confirmed but assumed that the fiber is hardly colored at the desired color specification values even subject to a heat treatment in an active atmosphere because the C polymer and the B polymer form the island components and the sea components. respectively. as to form an islands-in-sea structure and consequently, fiber surfaces are substantially covered with the B polymer as the sea component, where the B polymer forming the sheath component has a higher blend ratio. If the C polymer is blended with a higher blend ratio, the fiber is easily colored but suffered from impaired weavability and abrasion resistance.

However, even if a resin such as PPS, having an originally white color, is used as the B polymer, a colored fiber having the color specification values is obtainable by adopting, e.g., the specific condition as follows.

As a preferable manufacturing method the weight ratio C/(B+C) of the C polymer to the entire weights of the B and C polymers is set to 0.15 to 0.45, and after a yarn is spun as to satisfy the following conditions, the yarn is made subject to a heat treatment in an active atmosphere.

$MVb \geqq MVc$

Spinning Temperature $\geqq$ MPc+30° C.

$\gamma(\gamma=4Q/\pi r^3) \geqq 20000$ wherein: MVb, MVc are melting viscosities (poises) of the B and C polymers, measured by the method set forth in the embodiment, respectively; MPc is the melting point of the C polymer; $\gamma$ is a shear rate when spun ($sec^{-}$); Q is a spinning amount ($cm^3$/sec) of polymers per a single hole when the core and sheath type conjugate fiber is spun; r is a radius (cm) in a shear face direction of a nozzle hole.

The reason that use of such a method brings a conjugate fiber having the desired color specification values is not confirmed but assumed that the island components made of the C polymer are dispersedly located upon application of a high shear force where the C polymer forms micro island components and where the viscosity of the C polymer is adequately lowered in comparison with the B polymer, and upon subject to the heat treatment in the active atmosphere, the C polymer located around the fiber surface receives color by various subsidiary reactions to indicate the specific color specification values. In particular, when a straight chain PPS is used as the B polymer, a conjugate fiber having excellent physical property and the desired color specification values is obtainable in a productive way by controlling oxygen concentration and processing time and temperature.

From a view to effectiveness of coloring, the $\gamma$ is set to 30,000 or more and, preferably, to 40,000 or more. This reason is not confirmed but assumed that the island components made of the C polymer are readily located in a dispersed manner more around the fiber by raising the shear rate. It is desirable to raise the shear rate as making the fiber diameter larger from viewpoints of productivity of spinning and coloring. It is also preferable to set the $\gamma$ to 80,000 or less from a point of the spinning process.

When the above method is used, the spinning temperature should be at the temperature MPc plus 30° C. This reason is not apparent but assumed that the island components made of the C polymer cannot be dispersedly located around the fiber surfaces because the viscosity of the C polymer does not decrease enough where the spinning temperature is too low. However, because the polymer may suffer from decomposition if the spinning temperature is raised, it is preferable to set it at MPc plus 60° C. or less.

The spinning rate is preferably set to 650 m/min or more in an aspect to higher coloring efficiency and higher fiber property and, more preferably, to 900 m/min or more, and to 3,000 m/min or less in view of spinning stability. The MVb is preferably set to (MVc plus 1100) poises or less from a viewpoint of spinning and availability of smaller diameter fibers. From an aspect to coloring, the MVb is set to the MVc or more and, preferably, to the MVc plus 350 or more and more preferably, to the MVc plus 400 or more. The MVc is set to 600 poises or less in consideration of spinning, coloring efficiency, and abrasion resistance of the fiber and, preferably, to 500 poises or less and from an aspect to the fiber property preferably to 380 poises or more.

The heat treatment does not need the active atmosphere in the entire processes, and at least a part of the processes is made in the active atmosphere. At that time, any of a loosely tensioned heat treatment and a tightly tensioned heat treatment is used. From a viewpoint to coloring efficiency and fiber property, it is desirable to use a temperature condition between (MPb−80° C.) and (MPb), and particularly, it is desirable to treat the fiber in an atmosphere of an oxygen concentration of 5 to 22% by volume at the later half of the heat treatment for one hour or more. It is to be noted that the MPb denotes the melting point of the B polymer.

A desirable heat treatment atmosphere is a low humidity gas whose dew point is at −40° C. or less. It is preferable to implement a heat treatment with a temperature schedule of temperature increase from a temperature of the melting point of the core component minus 40° C. or lower than that to a temperature of the melting point of the sheath component. The processing time varies depending on cases from several minutes to 50 or 60 hours.

To supply heat, the heat treatment can use a method using carrier gases as media, a method using radiation from, e.g., a hot plate or infrared heater, a method done in contact with hot rollers or hot plates, or an internal heating method using microwave or the like. Such a heat treatment can be done in a form where the fiber is wound in a ring shape or folded (for instance, done while fibers are mounted on a metal net) or where the fiber is processed continuously between rollers. When the fiber is subject to a tightly tensioned heat treatment, it is desirable to heat it at a temperature of the melting point of the core component minus 80° C. or lower than that in exerting a tension of 1 to 10% of the breaking strength, and this process will further improve various property, especially, the modulus of elasticity. After made it into a textile form, a heat treatment may possibly be done, but it is desirable to thermally treat the fiber before the textile is formed in an aspect of process efficiency.

It is preferable to implement a heat treatment after an oiling agent of 0.01% by weight or more in proportion to the fiber weight, particularly 0.05% by weight or more, is applied onto the raw spun yarn to raise the coloring effects. The oiling agent on the fiber surface works to promote various subsidiary reactions and promotes favorable coloring for this invention. Application of the oiling agent remarkably improves the coloring effects, so that the conjugate fiber having the color specification values as defined in this invention can be obtained even where the fiber is spun in the above specified method and thermally treated in an inert gas atmosphere (e.g., a nitrogen atmosphere). From a viewpoint of the fiber property, the application amount of the oiling agent is preferably set to 3% by weight or less, more preferably, to 1% by weight or less.

As such an oiling agent, an agent preferably comes to be vaporized during the heat treatment from a viewpoint to the coloring efficiency, and an oiling agent made of emulsion is preferable in consideration of easiness to apply it to the fiber. An oiling agent capable of applying flatness and antistatic property to the fiber is preferable. More specifically, an oiling agent having a main ingredient of mineral oil, alkylene oxide copolymer, or aliphatic ester is desirably used, and from the above viewpoint, the oiling agent set forth in Formulas (13), (14) is preferable, and using them together gives further remarkable effects.

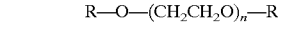

$$R—O—(CH_2CH_2O)_n—R \quad (13)$$

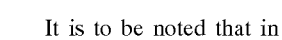

$$R—O—(CH_2CH_2O)_m—POOX \quad (14)$$

It is to be noted that in Formulas (13), (14), R denotes hydrocarbon groups of the carbon number of 3 to 30; n denotes an integer of 1 to 30; m denotes an integer of 1 to 30; X denotes Na or K.

It is preferable, in terms of coloring efficiency. handling, etc., to select the R from a straight chain hydrocarbon group having the carbon number of 8 to 15, the n from the integer of 8 to 15, the m from the integer of 1 to 5, the X from K. The oiling agents shown in following Formulas (15), (16) among oiling agents are particularly useful. The blend ratio of the oiling agent set forth in Formula (13) and the oiling agent set forth in Formula (14) (ratio by weight) is preferably set to 30:70 to 70:30.

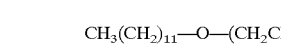

$$CH_3(CH_2)_{11}—O—(CH_2CH_2O)_{10}—(CH_2)_{11}CH_3 \quad (15)$$

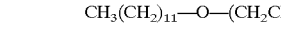

$$CH_3(CH_2)_{11}—O—(CH_2CH_2O)_2—POOX \quad (16)$$

Although the fiber can be colored with the desired color specification values by satisfying the above conditions and implementing the heat treatment, the heat treatment offers the coloring effects as well as is able to remarkably enhance the physical property of the fiber. A heat treatment for the purpose of coloring and a heat treatment for the purpose of improvement of physical property of the fiber can be done in the same process but can also be done in different processes. For example, after a heat treatment for the purpose of improvement of physical property of the fiber is made, another heat treatment for the purpose of coloring can be done in air or the like. When the heating conditions corresponding to the respect purposes are different, it is desirable to accomplish both purposes by implementing, after implementing one heat treatment for one purpose, the other heat treatment as to compensate shortage in heating for the other purpose. A heat treatment for the purpose of improvement of the physical property of the fiber can be implemented in an inert gas atmosphere such as a nitrogen gas or the like, in an active gas atmosphere such as an air containing oxygen, or in reduced pressure.

When a conjugate fiber is manufactured in a way not blending substantially any colorant, the fiber can gain excellent property since it does not lose the physical property of the fiber. More specifically the conjugate fiber may obtain the fiber strength of 10 g/d or more and the modulus of 400 g/d or more, particularly, the strength of 12 g/d or more and the modulus of 450 g/d or more, particularly, the strength of 16 g/d or more and the modulus of 500 g/d or more. When a fiber having high tensile strength and high modulus is used, a screen textile material can be made with excellent features such as size stability, durability, and printing property.

With this invention, the fiber surface may preferably have ups and downs. Formation of the ups and downs on the fiber surface improves adherence to photosensitive resins or the like and gives the fiber excellent abrasion resistance. The method to form such ups and downs is not limited, and some known methods such as a method to spin the fiber using a nozzle having an anisotropic cross-sectional hole, a method to form large and small diameter portions by partial drawing a method to make a fiber while containing many inorganic particles in polymers, a method to etch the fiber in a chemical process manner after the fiber is formed, or a method to etch the fiber under plasma can be used.

Although by adoption of such a method, a conjugate fiber having very fine ups and downs in a large number can be obtained, it is desirable to use a fiber having gentle ups and downs on the fiber surface because such a fiber is hardly cracked at the ups and downs due to abrasions and offers further remarkable effects. Formation of such gentle ups and downs on the fiber surface brings various effects, e.g., effects that strands during the heat treatment are reduced thereby enabling the fiber to be subject to a heat treatment done at a higher temperature and that the abrasion resistance is reduced to make easier the fiber processed (weaving or the like).

As another excellent effect of the fiber, the fiber can raise adherence to the photosensitive emulsion (hereinafter simply referred to as "emulsion") to thereby improve durability of printing plates, and furthermore can make unnecessary excessive exposures upon increase of the emulsion adherence to form the emulsion in a reverse pattern shape or stencil shape having a sharp edge when viewed from its top and a vertical edge when seen in a cross sectional direction. Consequently, the ink can be transmitted satisfactorily, and the fiber enables a printing plate to be produced with fine pitches of the emulsion layer. In other words, since printing can be made with the fine pitches, the fiber remarkably improves the printing property. This is further apparent in an art where printing precision and clearness is further demanded.

Figure 3:
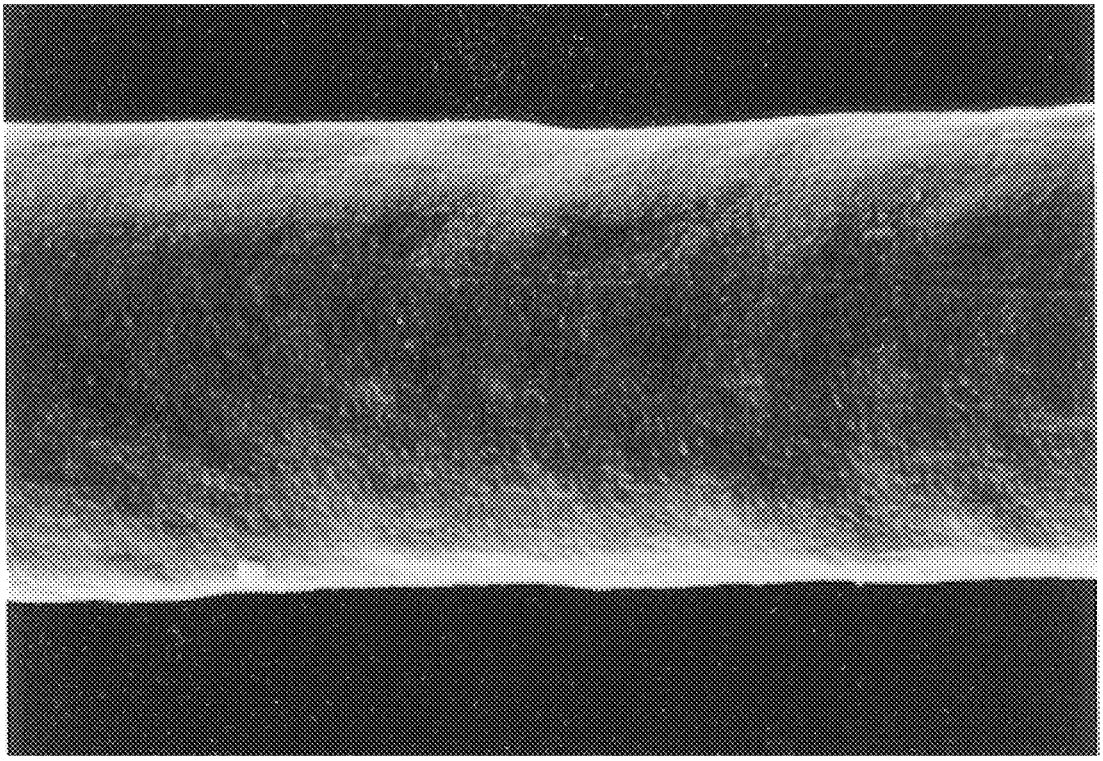
FIG. 3 is a scanning electron microscopic photograph showing an example of a surface configuration of the conjugate fiber having gentle ups and downs.

According to the invention, the fiber has gentle ups and downs on the fiber surface, and FIG. 3, a scanning electron microscope photograph, shows such a gentle ups-and-downs configuration on the fiber surface. The fiber having such gentle ups and downs, as different from a fiber having fine ups and downs by micro particles, hardly causes abrasion of guide members or scraping on the yarn, thereby making easy weaving of a high density screen textile material, as well as bringing remarkable effects in prevention of clogged meshes and improved ink transmission. The fiber can have better effects because the ups and downs are readily removed by abrasions from the fiber surface in comparison with a fiber formed with many fine ups and downs. The method to form such ups and downs is not limited. For example, the following method can be used.

$0.15 \leqq C/(B+C) \leqq 0.45$ $MVb \geqq MVc+350$ $\gamma(\gamma=4Q/\pi r^3) \geqq 20000$ wherein C/(B+C) indicates the weight proportion of the C polymer, and MVb MVc, γ, Q, and r indicate the same meanings as in the above expressions for spinning conditions.

The mechanism for forming such gentle ups and downs by the above method is not clear but assumed that the C polymer makes very fine island components and distributes the components much at the fiber surface, and the rigid C polymer thereby forms linear protrusions on the surface.

To form gentle ups and downs, it is desirable to set the viscosities of the B and C polymers in a specific relation. When the viscosity MVb of the B polymer falls less than (MVc+350) poises, a clear structure of ups and downs may not be formed readily, and contrarily, when the viscosity MVb of the B polymer exceeds (MVc+1100) poises, a phenomenon similar to a melt fracture occurs below the nozzle, thereby not only impairing spinning capability but also making difficult to form a fiber having a smaller diameter. To form the ups-and-downs structure, it is preferable to set $MVb \geqq MVc+400$. When a straight chain PPS is used as the B polymer, it has a great spinning capability and excellent physical property and readily makes the gentle ups and downs, so that the straight chain PPS can be desirably used.

The reason that the gentle ups and downs cannot be formed when the condition that $0.15 \leqq C/(B+C) \leqq 0.45$ is not met, is unknown but assumed that if the blend ratio of the C polymer is too small, the number of islands made of the C polymer would be reduced, so that the ups and downs caused by the C polymer would tend to be not formed, and if the blend ratio of the C polymer is too large, the island components made of the C polymer would become difficult to be formed.

Figure 4:
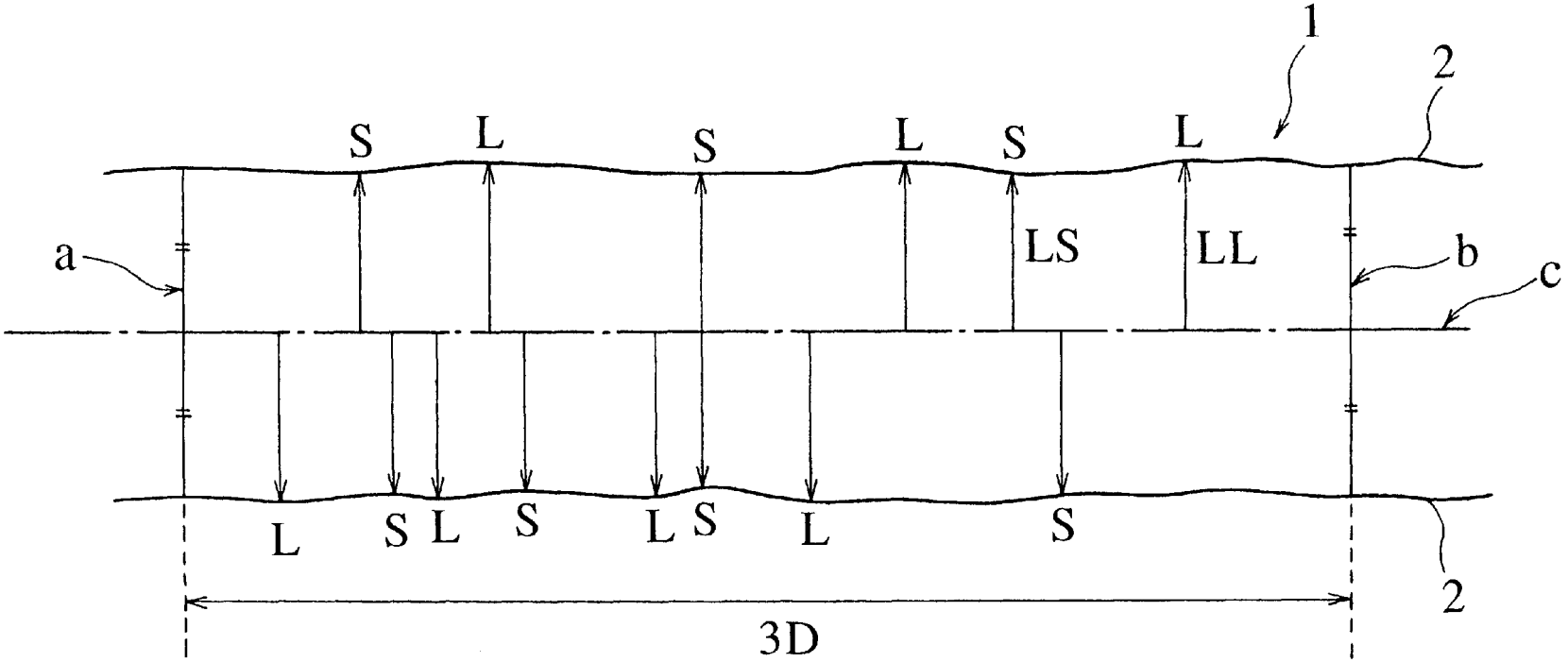
FIG. 4 is schematic diagram showing an example of a fiber side configuration.

A preferable configuration of the fiber having such gentle ups and downs according to the invention is shown in FIG. 4. As shown in FIG. 4, a profile of an outer side periphery of a fiber's picture taken in magnifying 1000 time by means of a scanning electron microscope is depicted wherein: numeral 1 represents a fiber; numeral 2 represents an edge of fiber's outer side periphery. A maximum point located in a fiber length 3D (D: mean fiber diameter) is referred to as L; a minimum point is referred to as S; a vertical line length from a center line C to the point L, is referred to as LL; and a vertical line length from the center line C to the point S is referred to as LS. A number of the combination (NM) of adjacent points L and S in which a differential (LL−LS) between the adjacent LI, and LS is 0.005 D or more is counted as a total with respect to both sides. A favorable mean value of the NM at three or more measuring points is 5 to 100, and more preferably, 10 to 50. From a viewpoint to the fiber strength, the (LL−LS) is 0.05 D or less, preferably, 0.03 D or less. The center line C herein is a line connecting centers of two line (a, b) which extend in an axial direction of the fiber in an area set up in the fiber length 3D.

Figure 5:
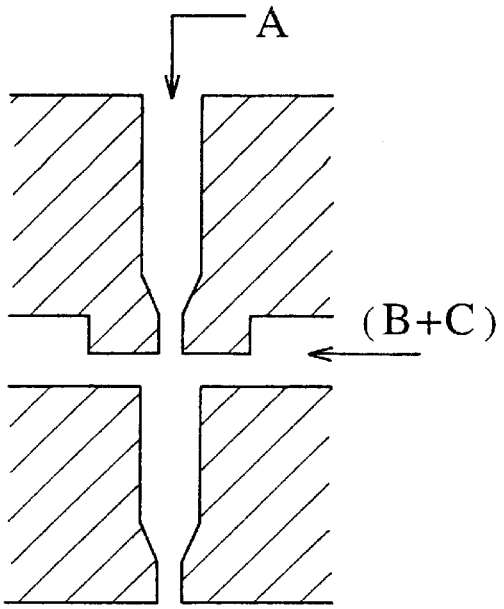
FIG. 5 is a cross section showing a spinneret usable when a core and sheath type conjugate fiber is spun.

The core and sheath type conjugate fiber can be spun using a known method, for example, using a nozzle shown in FIG. 5. In FIG. 5, A denotes the A polymer; B denotes the B polymer; C denotes the C polymer. A lateral cross section shape of the obtained fiber is not specifically limited. However, shapes shown in FIGS. 1(*a*) to 1(*g*) and FIG. 2 are exemplified as desired examples. In FIG. 1, A denotes the A polymer; B denotes the B polymer; C denotes the C polymer. The A polymer constitutes the core components; the blend of the B and C polymers constitutes the sheath component. The sheath component presumably has an islands-in-sea structure comprising island components and a sea component. FIG. 2 shows a state in which the B polymer presumably constitutes the sea component and the C polymer presumably constitutes the island components. By use of the above core and sheath type conjugate fiber, the fiber allows that printed images are free from blurring or running, that a problem such as leveling defects hardly occurs, that a high quality ink layer can be formed with a uniform thickness, and that a screen textile material is obtainable having excellent size stability and stability in a long period of time.

In this invention, other fibers having the above color specification values (i.e., fibers other than the invented conjugate fiber) can be used together with the fiber. Some fibers not having the color specification values may be used together as far as they do not impair the effects of the invention. From viewpoints of various properties such as an effect of halation prevention, size stability, etc., it is preferable to use the conjugate fiber as described above of 50% by weight, more preferably, 80% by weight, further more preferably, 90% by weight to form the screen textile material. When the whole screen textile material is made as to meet with the conditions of the color specification values, the high quality printing can be made even using any part of the screen textile material.

The method to manufacture the screen textile material using the core and sheath type conjugate fiber is not particularly limited, but it is preferable to weave it in a known method using the core and sheath type conjugate fiber as a weft and/or a warp. For example, a weaving pattern or a form of tangled portions of yarn is engineered; plural fibers having different diameters are woven together; a fiber having a relatively excellent flexibility is used; or some of the above is used in a proper manner. For example, if a twilled fabric structure is used as a weaving pattern, the textile material can be placed with a relatively high tension. If a fiber is woven with a tangled state as to make the fiber flexible largely, the textile material can be placed with a relatively high tension. By weaving fibers having different diameters together, an opening area can remain wide, and further more, the textile material can be placed with a relatively high tension upon large flexibility of the fiber at the fiber tangled portions. Also, use of a fiber having an excellent flexibility, and preferably, a high tensile strength and a relatively good surface elasticity, allows the textile material to be placed with a high tension. In terms of easiness to be processed, printing property, abrasive resistance, etc., the screen textile material is preferably made of a mesh woven using core and sheath type conjugate monofilaments.

The structure of the screen textile material is not particularly limited. To perform a high quality printing, it is preferable to set the opening area to 35% or more, more preferably, 37% or more, and further preferably, 40% or more. In terms of size stability, where the tear strength of the screen textile material is X (gf) and a yarn diameter of yarns arranged along the tearing direction among yams constituting the mesh woven is Y (microns), it is preferable to set that the value of $X/Y^2$ is 0.32 or more, more preferably, 0.35 or more. When the screen textile material satisfies the conditions of the above opening area and the value of $X/Y^2$, a printing plate having wide opening area and a high tension can be obtained. Accordingly, prominent printing can be made with a low skew or elongation of printed images with respect to the printing plate images, excellent size stability, and better positional precision such that printing positions do not shift, because printing can be made with high quality in printed images and because the textile material can be used in a state that a material to be printed is placed closely to printing images.

It is to be noted that the tear strength is a value measured in use of an Elemendolf type tear tensile tester in complying with JIS L 1096 D (Penjurum Method). In this invention, measurement sampling points are each ten points in weft and warp directions; eight measured values excepting the maximum and minimum values among the measured values of ten points each are averaged; and then, an average in the weft direction and an average in the warp direction are further averaged to compute a tear strength.

The term "opening area" means an areal occupying rate of an opening (where no fiber exists) within one pitch of weft and warp fibers constituting a screen textile material when the plane of the material is viewed. The opening area is a computed value obtained from the fiber diameter and density of the employed fiber. To compute the area, an official value of the fiber diameter is used for fiber diameter, and a value that actually measured by a densimeter from the obtained screen textile material is used for density (which is a number of fibers occupying within one inch, indicated by number/inch or mesh). The opening area S(%) is expressed by the following Expression where: the fiber diameter of the warp fiber or warp is f1 (microns); the fiber diameter of the weft fiber or weft is f2 (microns); the density of the warp (density in the weft direction) is M1 (number/inch or mesh); ); and the density of the weft (density in the warp direction) is M2 (number/inch or mesh).

$$S=[(25400/M1-f1)\cdot(25400/M2-f2)]/[(25400/M1)\cdot(25400/M2)]$$

Notedly, the above f1 corresponds to the fiber diameter Y of the warp fiber, and the above f2 corresponds to the fiber diameter Y of the weft fiber.

The tensile strength of the screen textile material is preferably designed to 200 gf or more, particularly, 300 gf or more and, more preferably, 400 gf or more. If the tensile strength is less than 200 gf, the material may be broken when highly tensioned depending on how it is tensioned, thereby possibly making a sufficiently high tensile printing plate unavailable.

The density of the screen textile material is 200 meshes or more, preferably, 250 meshes or more, further preferably, 300 meshes or more since such density allows easy printing of linear patterns arranged with high density, and from a viewpoint to the costs and productivity, it is preferable to set it to 350 meshes or less, particularly, 330 meshes or less.

The diameter of the fiber constituting the screen textile material is 45 microns or less, particularly, 40 microns or less, more preferably, 35 microns or less, and further preferably, 33 microns or less in order to make easier printing for fine linear patterns. When the fiber diameter is set to 35 microns or less, particularly, to 33 microns or less, a printing of linear patterns of 150 micron width, especially of 60 micron width, is surely made.

In prior arts, printing can be made with higher quality, as opening area is wider. That is, it is better to set the opening area wider in a screen textile material constituting a printing plate to perform high quality printing for obtaining a facial layer having a uniform thickness in which ink is sufficiently leveled as well as for obtaining a printing ink layer in a good shape free from running. However, a material having a wider opening area does not normally offer a high tensile printing plate, so that squeegeeing has to be made by spacing a printing surface of an article to be printed from the printing plate, in order to achieve high quality printing images. If the printing plate is largely spaced from the printing surface, however, a printing image having smaller skews in keeping the size and shape of the printing plate image may not be obtained, or a fine line printing cannot be made since positional shifts may occur and such shifts may cause blurs consequently.

In prior arts, particularly, a printing plate that an image including fine lines is printed with good size reproduction and without elongations, positional shifts, or blurs of the printing image could not be made. To print fine lines, a screen textile material used for such a printing plate is more advantageous as made of a thinner fiber. The printing plate made from the screen textile material made of fine fibers generally does not have a high tension and is likely poor for size reproduction. This invention. upon satisfaction of the above $X/Y^2$, can solve such problems of the prior art.

The screen textile material according to the invention can perform fine, clear, and stable printing in arts of the screen printing such as pattern printing, character or letter printing, nameplate printing, or color printing, etc. The material allows, particularly, precision printing having line width and line space of 150 microns or less with high size precision, high quality, and printing stability, and also makes possible printing having line width and line space of 60 to 100 microns. Accordingly, when the material applies to etching resist inks, metal plating resist inks, or the like, the material can contribute huge cost down for manufacturing process for, e.g., manufacturing a board with fine patterns for electronics devices. In addition to application in printing arts, the material can be used for various applications such as mesh clothes for filters, shield materials for electromagnetic wave, and so on.

EXAMPLES

Next, this invention is further described in exemplifying specific Examples. This invention is not limited to the following Examples. The measuring method for property of the material measured in each Example is as follows:

[Melting Viscosity (MV) Poises]

It was measured using Capyrograph made by Toyo Seiki Co. under conditions of 300° C., shear rate $\gamma$=1,000 $sec^{-1}$.

[Logarithmic Viscosity ($\eta$inh)]

Each specimen was solved in a pentafluorophenol by an amount of 0.1% by weight (60 to 80° C.), and correlation viscosity ($\eta$rel) of each specimen was measured using an Uppelode viscometer in a thermostat bath at 60° C. The $\eta$inh was computed by Formula, $\eta$inh=In ($\eta$rel)/c. The c denotes polymer concentration (g/dl).

[Color Specification Values]

A fabric constituted of the fiber was made and measured by a color analyzer (e.g., C-200S, made by Hitachi Mfg. Co.) by overlapping four sheets of the fabric of 20 mm×20 mm. If the density or the like is different, such a difference may affect the color specification values. Overlapping four sheets guarantees a measurement of the color specification values substantially free from errors. To minimize measurement errors in the color specification values, it is desirable to use a fabric of 20 mm×20 mm, but such a measurement can be done relatively without errors if the fabric size is about 10 mm×10 mm even though smaller than 20 mm×20 mm.

[Strength g/d]

In complying with JIS L 1013, using a tensile tester DCS-100, made by Shimazu Mfg. Co., a tensile breaking test was implemented under conditions of sample length 20 cm, initial load 0.1 g/d, tensile rate 10 cm/min. The strength was sought from the obtained stress-strain curve. An average of five measured points or more was taken.

[Modulus g/d]

In complying with JIS L 1013, using a tensile tester DCS-100, made by Shimazu Mfg. Co., a tensile breaking test was implemented under conditions of sample length 20 cm, initial load 0.1 g/d, tensile rate 10 cm/min. The modulus was sought from the obtained stress-strain curve according to an Expression, Modulus=(w/D)/(ΔL/L). The w is a load when elongated by ΔL; the D is a denier (d) of the fiber; the ΔL is a length elongated by the load; the L is an original length of the fiber.

[Fiber Diameter Microns]

A picture of the fiber side was taken by a scanning electron microscope by magnifying it 1,000 times. The fiber diameter was measured at arbitrary ten points, and the fiber diameter was assumed by an average of summation of the points.

[Abrasion Resistance (Guide Abrasion) Times]

Using a holding force tester made by Daici Kagaku Instruments Co., six monofilaments were passed through three comb guides, respectively, which were arranged as to angle at 120°, and while a load of 1 g/d was exerted to each filament, abrasion times (times) were measured at which naps (peeling or fibrilating) start to occur, where the filament receives a reciprocal movement under a stroke length of 3 cm and a speed of 95 times/min.

[Weavability]

After the fiber was woven using specimens, the surface of the fiber was observed by an optical microscope to evaluate the specimens as A, having substantially no peeling at the sheath component, as B, having only few peelings, as C, having some peelings, and as D, having many peelings.

[Opening Area (OPA) %]

The opening area is an areal occupying rate of an opening (where no fiber exists) within one pitch of weft and warp fibers constituting a screen textile material when the plane of the material is viewed and is computed by the following Expression.

$$S=[(25400/M1-f1)\cdot(25400/M2-f2)]/[(25400/M1)\cdot(25400/M2)]$$

wherein: the fiber diameter of the warp fiber or warp is f1 (microns); the fiber diameter of the weft fiber or weft is f2 (microns); the density of the warp (density in the weft direction) is M1 (number/inch or mesh);); and the density of the weft (density in the warp direction) is M2 (number/inch or mesh). The fiber diameter was an official value of the fiber diameter, and the density (which was a number of fibers occupying within one inch, indicated by number/inch or mesh) was a value that actually measured by a densimeter from the obtained screen textile material.

[Tear Strength gf]

The tear strength is a value measured in use of an Elemendorf type tear tensile tester in complying with JIS L 1096 D (Penjurum Method). In this invention, measurement sampling points are each ten points in weft and warp directions; eight measured values excepting the maximum and minimum values among the measured values of ten points each are averaged; and then, an average in the weft direction and an average in the warp direction are further averaged to compute a tear strength.

[Textile Tension mm]

A screen textile material and iron frame (square hollow structure of an outer size 950 mm×950 mm and an inner size 910 mm×910 mm, height of 30 mm, metal thickness of 2 mm) was used. The textile material was placed in the frame with tension under the following conditions. The average of measured values (tension force) in the weft and warp directions at the center of the stationary frame was measured by a tension gauge made of Sangiken Co. at respective times, and respective tensions right before the textile was fixed to the frame (i.e., right before the textile was fixed to the frame while the textile was tensioned), right after the textile was fixed to the frame, and seven days after the textile was fixed were evaluated.

Tension Condition for textile:

Textile tension force: maximum tension that does not break the screen textile material where a screen tensioner tensions the material in the warp and weft directions (i.e., tension right before breaking).

Textile tension method: indirect tension method (screen tension angle is bias 22.5°);

Tension Fixing: after the screen textile material was tensioned in a face direction with pulling force, a fixing frame was set below the material and secured by adhesive or the like.

[Minimum Off Contact mm]

A material seven days passed after the textile was fixed, obtained by the method set forth in the above measurement method of textile tension, was used to form a printing plate having a test pattern under the following conditions. Then, continuous printing was performed by changing a distance (off-contact) between a material to be printed (copper covered plate) and the surface of the printing plate under the following printing conditions. A minimum off contact was defined by a minimum distance between the material to be printed and the surface of the printing plate where no ink blur of the images was made even while 100 sheets were continuously printed.

1) Platemaking Condition

Photosensitive Emulsion: EX-420 (trade name), made by Kurita Kagaku Co.

Film thickness: 10 to 11 microns

Figure 6:
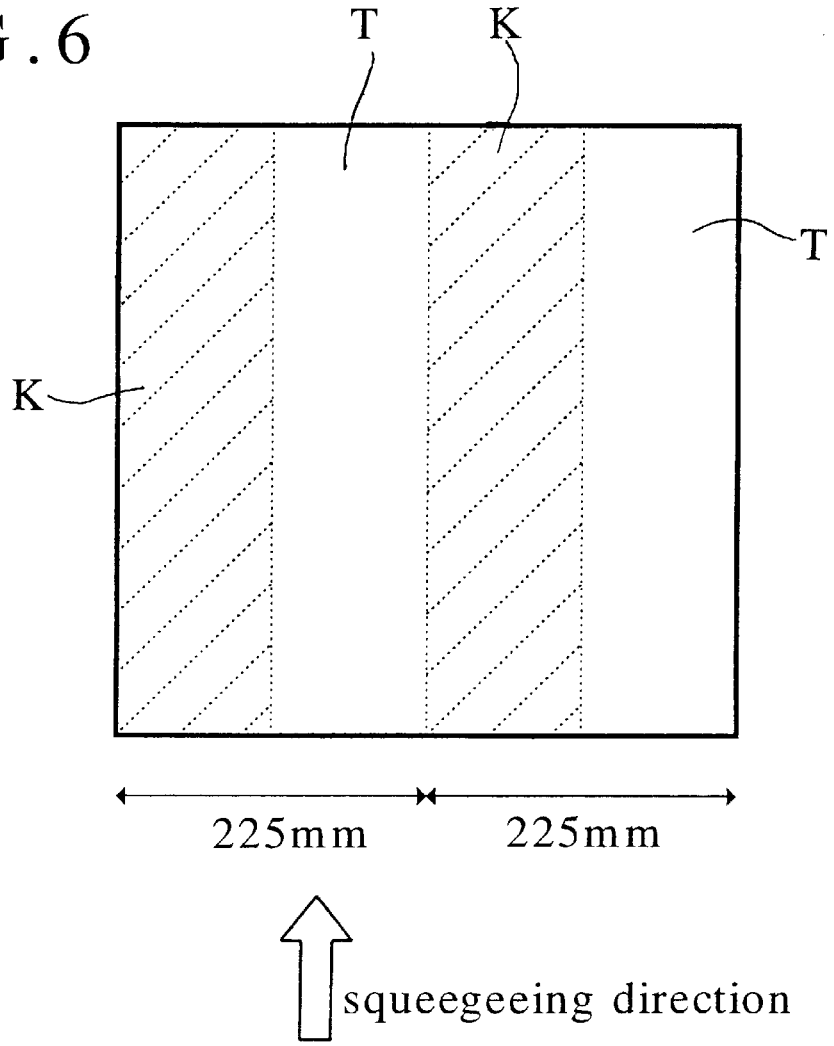
FIG. 6 is an illustration roughly showing a test pattern in a printing test.

Photo masks: photo masks having strip patterns, as shown in FIG. 6, line width/line space60/100 microns in T of FIG. 6, and line width/line space=100/100 microns in K of FIG. 6.

Exposure machine: FL-2S (trade name), made by Ushio yuteku

Exposure time: 120 k (417 mJ/cm$^2$)

Development: water development by means of a shower spray (water pressure 8 kg/cm$^2$, time 120 sec.)

2) Printing Condition

Printing Machine: LS-77A (trade name), made by New Long Seimitsu Co.

Squeegee: squeegee made of urethane rubber, hardness 70°, attachment angle 70°.

Printing pressure: 0.25 mm

Lift Up: 0 mm

Squeegee Speed: 300 mm/sec.

Ink Used: ER-70B (trade name) made by Somahru Co., viscosity of 120 poises (25° C.)

[Halation Prevention Effect (HL) Microns]

Continuous printing was made in a manner as set forth in the measurement method of the minimum off contact (executed by the measurements of the minimum off contact), and conditions of the pattern lines (line width/line space= 60/100 microns) of images where the ink was dried on the obtained $101^{st}$ to $103^{rd}$ printed sheets were observed.

First, pictures were taken by magnifying the image pattern lines 200 times by means of a length meter DR-550F, Dainippon Screen Mfg. Co. Then, the maximum and minimum values of the line widths were measured on the pictures (5 cm×5 cm or more) with respect to twenty lines or more, and a summation of a differential between the maximum line width value (microns) and the standard line width value (60 microns) and a differential between the minimum line width value (microns) and the standard line width value (60 microns) was calculated. An average of respective calculated values with respect to each of the plural fibers was evaluated as an HL value. Changes in line width at broken portion on the line width, which were presumably caused by peeling between the core and the sheath or naps were excluded. A smaller HL value indicates a larger effect on halation prevention.

[Line Tearing Property]

Continuous printing was made in a manner as set forth in the measurement method of the minimum off contact (executed by the measurements of the minimum off contact), and conditions of the pattern lines of images where the ink was dried on the obtained $101^{st}$ to $103^{rd}$ printed sheets were observed.

The image pattern lines were magnified 150 times by means of a length meter DR-550F, Dainippon Screen Mfg. Co., and the pattern lines of line widths of 60, 100 microns, respectively, were observed. The line tear was evaluated using the following reference.

A . . . No tear was found.

B . . . Few tears were found.

C . . . Many tears were found.

(Examples 1 to 5, Comparative Examples 1 to 7

As the A polymer, a thermotropic liquid crystalline polyester (melting point 280° C., melting viscosity 410 poises, ηinh=4.20 dl/g) having the structural units (A), (B) shown in Formulas (11), (12) of 73/27 mole % was used; as the B polymer, a straight chain PPS (see Table 1A and 1B, for MVb, MPb) was used; as the C polymer, a thermotropic liquid crystalline polyester having the structural units (A), (B) shown in Formulas (11), (12) of 73/27 mole % (see Table 1A and 1B, for MVc, MPc) was used.

First, the B and C polymers were used. Blend pellets having the C blend ratio C/(B+C) shown in Table 1A, 1B were mixed by means of a biaxial extruder and produced. Then, the core component and sheath component were supplied to different extruders, and after the resins were melted, a core and sheath type conjugate fiber was conjugately spun with about 9 deniers as to render the sheath component ratio R=0.40 under the conditions set forth below and in Table 1A and 1B.

Nozzle Diameter: 2r=0.015 cm

Polymer Spinning Amount per unit hole: Q=0.015 $cm^3$/sec

Shear rate: $\gamma$=44300 $sec^{-1}$

Spinning rate: 1100 m/min

In Comparative Examples 6, 7, conditions of nozzle hole diameter 2r=0.02 cm, shear rate $\gamma$=18700 $sec^{-1}$ were used.

An oiling agent blended of the oiling agent as set forth in Formula (15) and the oiling agent as set forth in Formula (16) in a proportion of 60:40 was applied to the obtained monofilaments in a proportion (percentage by weight) shown in Table 1A, 1B with respect to the monofilaments. The monofilaments were then wound around a multi-hole bobbin as to make the density about 0.55 g/cc and then thermally treated. During the heat treatment, it was heated at a fixed temperature increase rate from the room temperature to 250° C. in spending for 5 hours in a nitrogen atmosphere, then heated at a fixed temperature increase rate from 250° C. to the temperature shown in Table 1A, 1B in spending for 10 hours in the nitrogen atmosphere, and then heated for 3 hours at the temperature shown in Table 1A, 1B in an atmosphere (in Table 1A, 1B, N process denotes nitrogen atmosphere; A process denotes an atmosphere of 10% oxygen concentration where air was brought in the system), to manufacture a fiber.

The obtained monofilament fiber was used as the weft and warp to weave a plain fabric, and a raw textile of the plain fabric having about 250 meshes respectively in weft and warp densities was created. Subsequently, the obtained raw textile was placed in a tenter, and the invented screen textile material was formed by a heat setting process in an ordinary method. The results are shown in Table 1A, 1B.

EXAMPLES 6, 7

As the A polymer, a thermotropic liquid crystalline polyester (melting point 280° C., melting viscosity 410 poises, ηinh=4.20 dl/g) having the structural units (A), (B) shown in Formulas (11), (12) of 73/27 mole % was used; as the B polymer, a straight chain PPS (see Table 1A and 1B, for MVb, MPb) was used; as the C polymer, a thermotropic liquid crystalline polyester having the structural units (A), (B) shown in Formulas (11), (12) of 73/27 mole % (see Table 1A and 1B, for MVc, MPc) was used.

First, the B and C polymers were used. Blend pellets having the C blend ratio C/(B+C) shown in Table 1A were mixed by means of a biaxial extruder and produced. Then, the core component and sheath component were supplied to different extruders, and after the resins were melted, a core and sheath type conjugate fiber was conjugately spun with about 13 deniers as to render the sheath component ratio R=0.40 under the conditions set forth below.

Nozzle Diameter: 2r=0.015 cm

Polymer Spinning Amount per unit hole: Q=0.021 $cm^3$/sec

Shear rate: $\gamma$=63900 $sec^{-1}$

Spinning rate: 1100 m/min

An oiling agent substantially the same as the above Example 1 was applied to the obtained monofilaments in a proportion (% by weight) shown in Table 1A. The monofilaments were then wound around a multi-hole bobbin as to make the density about 0.42 g/cc and then thermally treated. During the heat treatment, it was heated at a fixed temperature increase rate from the room temperature to 250° C. in spending for 5 hours in a nitrogen atmosphere, then heated at a fixed temperature increase rate from 250° C. to the temperature shown in Table 1A in spending for 10 hours in the nitrogen atmosphere, and then heated for 3 hours at the temperature shown in Table 1A, 1B in an atmosphere (in Table 1A, 1B, N process denotes nitrogen atmosphere; A process denotes an atmosphere of 10% oxygen concentration where air was brought in the system), to manufacture a fiber. The invented screen textile material was formed in substantially the same way as in Example 1. The results are shown in Table 1A.

EXAMPLE 8

A conjugate fiber was manufactured in substantially the same way as Example 6 except use of a straight chain PPS (MPb 280° C., MVb 1170 poises), as the B polymer, in which a cadmium yellow pigment (Pigment Yellow 35: C.I. 77117) of 0.3% by weight was blended in the B polymer, thereby manufacturing the screen textile material. The results are shown in Table 1A.

TABLE 1A

| | Example 1 | Example 2 | Example 3 | Example 4 | Example 5 | Example 6 | Example 7 | Example 8 |
|---|---|---|---|---|---|---|---|---|
| MVb (poises.) | 1100 | 800 | 1100 | 1100 | 600 | 1100 | 1100 | 1170 |
| MPb (° C.) | 280 | 280 | 280 | 280 | 279 | 280 | 280 | 280 |
| MVC (poises) | 410 | 410 | 410 | 410 | 410 | 410 | 480 | 480 |
| MPc (° C.) | 280 | 280 | 280 | 280 | 280 | 280 | 282 | 280 |
| C blend ratio | 0.33 | 0.33 | 0.33 | 0.33 | 0.33 | 0.33 | 0.33 | 0.33 |
| Spinning temp. (° C.) | 315 | 315 | 315 | 315 | 315 | 320 | 320 | 315 |
| Shear rate ($sec^{-1}$) | 44300 | 44300 | 44300 | 44300 | 44300 | 63900 | 63900 | 63900 |
| Oiling agent attaching amount (% by weight) | 0.3 | 0.1 | 0.3 | 0 | 0.3 | 0.1 | 0.1 | 0 |
| Heat treatment atmosphere | A process | A process | N process | A process | A process | A process | A process | N process |
| Heat treatment temp. (° C.) | 272 | 272 | 272 | 272 | 270 | 275 | 275 | 275 |
| Fiber diameter (μm) | 30.3 | 29.9 | 30.5 | 30.3 | 30.0 | 36.7 | 36.0 | 36.3 |
| Strength (g/d) | 17.7 | 18.6 | 19.6 | 19.9 | 20.1 | 18.3 | 18.6 | 9.2 |
| Modulus (g/d) | 543 | 522 | 563 | 573 | 583 | 553 | 560 | 479 |
| Color specification values b* | 28.1 | 26.3 | 20.3 | 23.7 | 19.7 | 27.3 | 29.3 | 31.7 |
| a* | 5.2 | 4.9 | 2.4 | 3.0 | 2.3 | 3.3 | 4.9 | 6.7 |
| L* | 66.8 | 68.7 | 72.2 | 70.3 | 72.5 | 68.3 | 65.3 | 68.3 |
| NM Number | 14 | 7 | 18 | 16 | 0 | 23 | 32 | 28 |
| Abrasive resistance | 856 | 662 | 799 | 760 | 573 | 1020 | 993 | 532 |
| Weavability | A | A | A | A | B | A | A | B |
| OPA (%) | 49 | 49 | 49 | 49 | 49 | 47 | 47 | 47 |
| Tear strength (gf) | 528 | 540 | 570 | 572 | 592 | 1700 | 1740 | 1570 |
| $X/Y^2$ | 0.58 | 0.60 | 0.61 | 0.62 | 0.66 | 1.26 | 1.34 | 1.19 |
| Tension before fixing screen | 0.55 | 0.53 | 0.50 | 0.50 | 0.48 | 0.38 | 0.36 | 0.70 |
| Tension after fixing screen | 0.62 | 0.60 | 0.55 | 0.56 | 0.53 | 0.45 | 0.41 | 0.78 |
| Tension 7 days after | 0.69 | 0.66 | 0.60 | 0.62 | 0.58 | 0.52 | 0.47 | 0.86 |
| Minimum off contact | 1.8 | 1.8 | 1.7 | 1.7 | 1.6 | 1.5 | 1.5 | 2.5 |
| HL (μm) | 0.52 | 0.93 | 1.32 | 1.24 | 1.53 | 1.88 | 1.90 | 2.25 |
| Line tear 60 μm | A | A | A | A | B | B | B | B |
| 100 μm | A | A | A | A | A | A | A | A |

Table 1B

| | Comp. Example 1 | Comp. Example 2 | Comp. Example 3 | Comp. Example 4 | Comp. Example 5 | Comp. Example 6 | Comp. Example 7 |
|---|---|---|---|---|---|---|---|
| MVb (poises.) | 1100 | 800 | 1100 | 420 | 1100 | 1100 | 1100 |
| MPb (° C.) | 280 | 280 | 280 | 280 | 280 | 280 | 280 |
| MVC (poises) | | 410 | 480 | 480 | 410 | 410 | 410 |
| MPc (° C.) | | 280 | 282 | 280 | 280 | 280 | 280 |
| C blend ratio | 0 | 0.12 | 0.50 | 0.33 | 0.33 | 0.33 | 0.33 |
| Spinning temp. (° C.) | 315 | 315 | 320 | 315 | 300 | 315 | 315 |
| Shear rate ($sec^{-1)}$ | 44300 | 44300 | 44300 | 44300 | 44300 | 18700 | 18700 |
| Oiling agent attaching amount (% by weight) | 0.1 | 0.1 | 0.1 | 0.3 | 0.3 | 0.3 | 0 |
| Heat treatment atmosphere | N process | N process | A process | A Process | A process | A process | N process |
| Heat treatment temp. (° C.) | 270 | 270 | 275 | 270 | 270 | 270 | 272 |
| Fiber diameter (μm) | 30.2 | 31.1 | 30.5 | 31.0 | 30.3 | 30.0 | 31.0 |
| Strength (g/d) | 10.2 | 14.2 | 13.7 | 15.9 | 13.3 | 12.7 | 19.3 |
| Modulus (g/d) | 453 | 492 | 503 | 573 | 503 | 521 | 549 |
| Color specification values b* | 3.3 | 16.3 | 27.2 | 12.6 | 11.0 | 13.7 | 10.9 |
| a* | 0.6 | 1.8 | 5.3 | 1.3 | 2.1 | 1.9 | 2.2 |
| L* | 86.2 | 69.5 | 65.2 | 82.0 | 79.3 | 82.1 | 81.3 |
| NM Number: | 0 | 1 | 34 | 0 | 28 | 19 | 15 |
| Abrasive resistance | 393 | 477 | 263 | 373 | 367 | 473 | 818 |
| Weavability | D | B | D | D | C | B | A |
| OPA (%) | 49 | 49 | 49 | 49 | 49 | 49 | 49 |
| Tear strength (gf) | 355 | 396 | 377 | 402 | 357 | 357 | 568 |
| $X/Y^2$ | 0.39 | 0.41 | 0.41 | 0.42 | 0.39 | 0.4 | 0.59 |

Table 1B-continued

| | Comp. Example 1 | Comp. Example 2 | Comp. Example 3 | Comp. Example 4 | Comp. Example 5 | Comp. Example 6 | Comp. Example 7 |
|---|---|---|---|---|---|---|---|
| Tension before fixing screen | 0.93 | 0.62 | 0.62 | 0.58 | 0.65 | 0.68 | 0.50 |
| Tension after fixing screen | 1.01 | 0.69 | 0.68 | 0.64 | 0.71 | 0.74 | 0.56 |
| Tension 7 days after | 1.09 | 0.76 | 0.76 | 0.70 | 0.78 | 0.81 | 0.61 |
| Minimum off contact | 3.0 | 2.0 | 2.0 | 1.8 | 2.2 | 2.3 | 1.7 |
| HL (μm) | 7.53 | 3.06 | 3.12 | 4.33 | 4.30 | 4.12 | 4.21 |
| Line 60 μm | C | C | C | C | C | C | C |
| tear 100 μm | C | B | C | C | C | B | B |

The screen textile material of Examples of the invention is excellent in property such as suitability for clear printing or the like, and particularly, the materials made in Examples 1 to 4 have excellent property for weaving and hardly show naps or peelings between core and sheath even in repeating printing for a long time, because it is colored to the specific color specification values by a method not using any colorant and because it uses a conjugate fiber having high tensile strength and high modulus where the fiber diameter is very small, and the material also can do clear printing free from positional shifts for a long time since the material has a significant effect on prevention of halation. According to the invention, further fine lines can be printed clearly and precisely, and the screen textile material offers repetitive printing without printing positional shifts.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A screen textile material comprising a core and sheath conjugate fiber comprising (1) a core component formed of (A) thermotropic liquid crystalline polyester and (2) a sheath component formed by blending (B) flexible thermoplastic polymer and (C) thermotropic liquid crystalline polyester, wherein the amount of polyester (C) to the mixture of polymer (B) and polyester (C), namely {(C)/(C+B)}, is from 0.15 to 0.45, wherein the core and sheath conjugate fiber has the following color specification values:

$$18 \leqq b^* \leqq 35 \quad (1)$$

$$0.5 \leqq a^* \leqq 10 \quad (2)$$

$$55 \leqq L^* \leqq 80 \quad (3)$$

wherein $b^*=200[(Y/Y_0)^{1/3}-(Z/Z_0)]$ $a^*=500[(X/X_0)^{1/3}-(Y/Y_0)^{1/3}]$ $L^*=116(Y/Y_0)^{1/3}-16$, and X, Y, and Z denote tristimulus values.

2. The screen textile material according to claim 1 having the following color specification values a*, b* and L*:

$33 \geqq b^* > 25$ $5.5 \geqq a^* \geqq 1.0$ $78 \geqq L^* \geqq 60$.

3. The screen textile material according to claim 1 wherein the color specification value is obtained by subjecting a substantially pigment-free sheath and core conjugate fiber comprising (1) a core component formed of (A) thermotropic liquid crystalline polyester and (2) a sheath component formed by blending (B) flexible thermoplastic polymer and (C) thermotropic liquid crystalline polyester, wherein the amount of polyester (C) to the mixture of polymer (B) and polyester (C), namely {(C)/(C+B)}, is from 0.15 to 0.45, formed by melt-spinning at a spinning temperature which is at least 30° C. higher than the melting point, MPc, of the polyester (C) at a shear rate of at least 20,000 ($sec^{-1}$), under conditions that MVb≧MVc, where MVb and MVc are melting viscosities (poises) of the polymer (B) and polyester (C), respectively, to a heat treatment in an active atmosphere.

4. The screen textile material according to claim 3 wherein the substantially pigment free conjugate fiber is obtained by melt-spinning the core and sheath polymers at a shear rate of at least 30,000 $sec^{-1}$, and at a spinning temperature, Ts, wherein MPc+60° C.≧Ts≧MPc+30° C.

5. The screen textile material according to claim 3, wherein the substantially pigment-free conjugate fiber is obtained by melt-spinning the core and sheath polymers at a shear rate of at least 30,000 $sec^{-1}$, at a spinning temperature, Ts, wherein MPc+60° C.≧Ts≧MPc+30° C., and a spinning rate of at least 650 m/min, under conditions that MVb+1100≧MVc≧MVb+350.

6. The screen textile material according to claim 1, wherein the core and sheath conjugate fiber contains no more than 0.01% by weight of colorant.

7. The screen textile material according to claim 1, wherein the core and sheath conjugate fiber does not contain added colorant.

8. The screen textile material according to claim 1, wherein the core and sheath type conjugate fiber has a strength of 10 g/d or more.

9. The screen textile material according to claim 1, wherein the core and sheath conjugate fiber has a modulus of elasticity of 400 g/d or more.

10. The screen textile material according to claim 1, wherein the core and sheath conjugate fiber contains a colorant in an amount of 0.1% by weight or less.

11. The screen textile material according to claim 1, wherein flexible thermoplastic polymer (B) is polyphenylene sulfide.

12. The screen textile material according to claim 1, wherein the core and sheath conjugate fiber has a diameter of 45 microns or less.

13. The screen textile material according to claim 1, wherein the core and sheath conjugate fiber has a surface having gentle ups and downs.

14. The screen textile material according to claim 1, wherein the screen textile material is a mesh woven using core and sheath conjugated monofilaments.

15. The screen textile material according to claim 14, wherein the mesh woven has a tear strength X (gf) and a yarn diameter Y (microns) of yarns arranged along the tearing direction among yarns constituting the mesh woven, and wherein the mesh woven satisfies that the value of $X/Y^2$ is 0.32 or more and that an opening area is 35% or more.

16. The screen textile material according to claim 1, wherein the screen textile material has a tear strength of 200 gf or more.

17. The screen textile material according to claim 1, wherein the screen textile material has a density of 200 meshes or more.

18. The screen textile material according to claim 1, wherein the blending ratio of the C polymer is 0.25 to 0.4.

* * * * *

UNITED STATES PATENT AND TRADEMARK OFFICE

CERTIFICATE OF CORRECTION

PATENT NO. : 5,981,408
DATED : November 9, 1999
INVENTOR(S) : Junyo Nakagawa, et al.

It is certified that error appears in the above-identified patent and that said Letters Patent is hereby corrected as shown below:

Column 24,
Line 18, please change "$33 \geq b^* > 25$" to -- $33 \geq b^* \geq 25$ --,
Line 49, please change "$MVb+1100 \geq MVc \geq MVb+350$" to
-- $MVc+1100 \geq MVb \geq MVc+350$ --,
Line 57, delete "type".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*